US007317170B2

(12) United States Patent
Neumann et al.

(10) Patent No.: US 7,317,170 B2
(45) Date of Patent: Jan. 8, 2008

(54) ELECTRONIC FUNCTION RELAY

(75) Inventors: Siegfried Neumann, Kümmersbruck (DE); Fritz Royer, Hahnbach (DE); Uwe Weiss, Amberg (DE); Christian Widmann, Poppenricht (DE)

(73) Assignee: Siemens Aktiengesellschaft, Munich (DE)

( * ) Notice: Subject to any disclaimer, the term of this patent is extended or adjusted under 35 U.S.C. 154(b) by 6 days.

(21) Appl. No.: 11/454,039

(22) Filed: Jun. 16, 2006

(65) Prior Publication Data

US 2007/0001799 A1 Jan. 4, 2007

(30) Foreign Application Priority Data

Jun. 20, 2005 (EP) ..... 05013266

(51) Int. Cl.
*H01H 9/02* (2006.01)
*H01H 51/00* (2006.01)

(52) U.S. Cl. ..... 200/305; 335/78; 335/185

(58) Field of Classification Search ..... 200/305, 200/292, 281, 284, 289; 335/170–176, 185–202, 335/78, 166
See application file for complete search history.

(56) References Cited

U.S. PATENT DOCUMENTS 5,696,475 A * 12/1997 Yoshitani et al. ..... 335/78
6,975,192 B2 * 12/2005 Disalvo ..... 335/18
7,161,104 B2 * 1/2007 Bergh et al. ..... 200/305
2005/0067267 A1 * 3/2005 Bergh et al. ..... 200/305
2006/0132266 A1 * 6/2006 Disalvo ..... 335/18

FOREIGN PATENT DOCUMENTS

DE 10 2004 045 205 A1 4/2005
EP 0 940 831 A2 9/1999
EP 0 940 831 A3 9/1999

* cited by examiner

*Primary Examiner*—Elvin Enad
*Assistant Examiner*—M. Fishman
(74) *Attorney, Agent, or Firm*—Harness, Dickey & Pierce, P.L.C.

(57) ABSTRACT

A simple and low-cost electronic function relay is specified, for example an overload relay with a bistable printed circuit board relay module. The relay includes an engagement point for mechanical operation. The relay further includes a separate reset mechanism, which can be coupled to the printed circuit board relay module, and a switching lever, which corresponds with the engagement point, for manual resetting of the printed circuit board relay module to a switched-on position.

19 Claims, 4 Drawing Sheets

ELECTRONIC FUNCTION RELAY

The present application hereby claims priority under 35 U.S.C. § 119 on European patent application number EP 05013266 filed Jun. 20, 2005, the entire contents of which is hereby incorporated herein by reference.

FIELD

The invention generally relates to an electronic function relay, for example an electronic overload relay.

BACKGROUND

A function relay is known from DE 10 2004 045 205 A1. The known function relay has a bistable relay structure and a reset structure in a common housing, and can be mounted on a printed circuit board by way of a number of contact pins, which project out of the housing. The reset structure includes a switching lever, which corresponds with the relay structure, and an operating element which can be manually deflected elastically against spring pressure and acts via a driver on the switching lever in such a manner that, when the operating element is operated, the switching lever is moved to a reset position which corresponds with the switched-on position of the printed circuit board relay module. The operating element and the switching lever are in this case guided in the housing in such a manner that the driver is mechanically decoupled from the switching lever in a rest position and in an operating position of the operating element.

A thermal overload relay with contact pins for mounting on a printed circuit board is also known from EP 0 940 831 A2.

Electronic overload relays with their own supply are normally used for protection of an electric motor against overloading. For this purpose, the overload relay is in general connected directly downstream from a switching element associated with the motor, in particular a contactor, in the motor output from an electrical supply network. In the event of a fault, that is to say in the event of overloading, the contactor is disconnected by the overload relay, and is thus automatically isolated from the electrical power supply.

Conventionally, after disconnection, an overload relay is mechanically reset to a switched-on state again, in particular by operation of a reset button. Alternatively, electrical resetting by way of a so-called auto reset can be provided for an overload relay. The electrical energy which is required for the auto reset is initially stored in a capacitor associated with the overload relay, and is available after disconnection for resetting of the relay.

A conventional overload relay generally has a magnetic circuit with a switching rocker fitted with permanent magnets. The magnetic circuit can be electromagnetically excited by a coil, so that the switching rocker moves in a bistable manner from a switched-on position to a switched-off position under the influence of an electrical pulse, and appropriate switching contacts of the overload relay are operated during this process. A corresponding mechanical design is generally integrated in the overload relay, for manual resetting of the relay.

As an alternative to the overload switching described above, a function relay can also carry out another protection or monitoring function, depending on the nature of associated control electronics. In the above sense, a function relay may, in particular, also be in the form of an undervoltage release, temperature monitor, a filling level sensor, etc.

SUMMARY

At least one embodiment of the invention may include specifying an electronic function relay, for example an overload relay, such as one which can be produced easily and/or at low cost.

According to at least one embodiment of the invention, the function relay has two separate components which can be mechanically coupled to one another, specifically on the one hand a printed circuit board relay module (referred to for short in the following text as a relay module), and on the other hand a reset mechanism. The relay module is in this case provided with an engagement point, which allows mechanical operation of the relay module. An engagement point may, in the functional sense, be any device/method which allow the switching state of the relay module to be mechanically influenced from the outside.

In particular, the engagement point may be formed by a housing opening in the relay module, through which the switching mechanism of the relay module is accessible from the outside. As an alternative to this, the engagement point may also be formed by a part of the switching mechanism which projects out of the housing of the relay module. The reset mechanism has a switching lever which corresponds with the engagement point and is designed in such a manner that the relay module can be reset to a switched-on position by direct or indirect manual operation of this switching lever.

In particular, at least one embodiment of the invention allows the use of a printed circuit board relay module as part of the overload protection for an electric motor. Relay modules such as these are commercially available as mass-produced articles and thus cost considerably less than the switching mechanism of a conventional overload relay.

In one example embodiment, the reset mechanism has a mounting frame which is produced in particular in the form of a plastic injection-molded part and on which the switching lever is mounted such that it can pivot, as part of a rocker. The mounting frame and the switching lever or the rocker are in this case expediently designed in such a manner that the switching lever is fixed such that it cannot rotate at the free end in the engagement point when the reset mechanism is mounted on the relay module, so that the pivoted position of the rocker is unambiguously predetermined by the switching state of the relay module. This makes it possible to see the switching state of the relay module from the pivoted position of the rocker. In particular, the reset mechanism for this purpose has a switch position indicator, which is mechanically coupled to the rocker and is thus moved with it during pivoting of the rocker. The switch position indicator in one particularly simple embodiment is formed by the free end of an arm which is integrally formed on the rocker, in particular approximately at right angles to the switching lever.

The reset mechanism also has an operating element which can be manually deflected elastically against spring pressure. This is provided with a driver which interacts with the switching lever or with the rocker in such a manner that the driver moves the switching lever to a reset position, which corresponds with the switched-on position of the relay module, with the operating element being operated.

The operating element is in this case guided on the mounting frame in such a manner that the driver is mechanically decoupled from the switching lever, both in a rest position and in an operating position of the operating element. This allows so-called free-tripping of the overload relay, in which case the relay module can trip even when the operating element is operated.

In one example embodiment of the invention, free-tripping is provided in a mechanically simple and effective manner in that the driver can be deflected (in particular elastically) with respect to a body of the operating element, with the driver being positively coupled to a corresponding guide on the mounting frame, for coupling to and decoupling from the switching lever.

One simple embodiment of the reset mechanism, which is easy to operate and is fail-safe, is achieved by the body of the operating element being essentially cylindrical and being guided on the mounting frame, such that it can be moved axially, in the form of a push button.

A technically simple and effective connection between the relay module and the reset mechanism is also expediently achieved in that the reset mechanism can be snapped onto the relay module.

In particular, advantages which may be achieved by at least one embodiment of the invention may include the fact that the use of the printed circuit board relay module, which is produced as a mass-produced article, as the switching element of an electronic function relay, in particular of an overload relay in conjunction with a separate reset mechanism, allows the function relay to be produced at particularly low cost. The use of a printed circuit board relay module furthermore allows direct integration of the function relay in an electronic circuit. The separate reset mechanism is mechanically simple and compact with a small number of parts, and can thus likewise be produced at low cost. Despite the small size, the reset mechanism has an advantageous functionality, including free-tripping and switch position indication. The function relay can also be installed comparatively easily.

BRIEF DESCRIPTION OF THE DRAWINGS

One example embodiment of the invention will be explained in more detail in the following text with reference to the drawings, in which.

Parts and variables which correspond to one another are always provided with the same reference symbols in all of the figures.

DETAILED DESCRIPTION OF THE EXAMPLE EMBODIMENTS

Figure 1:
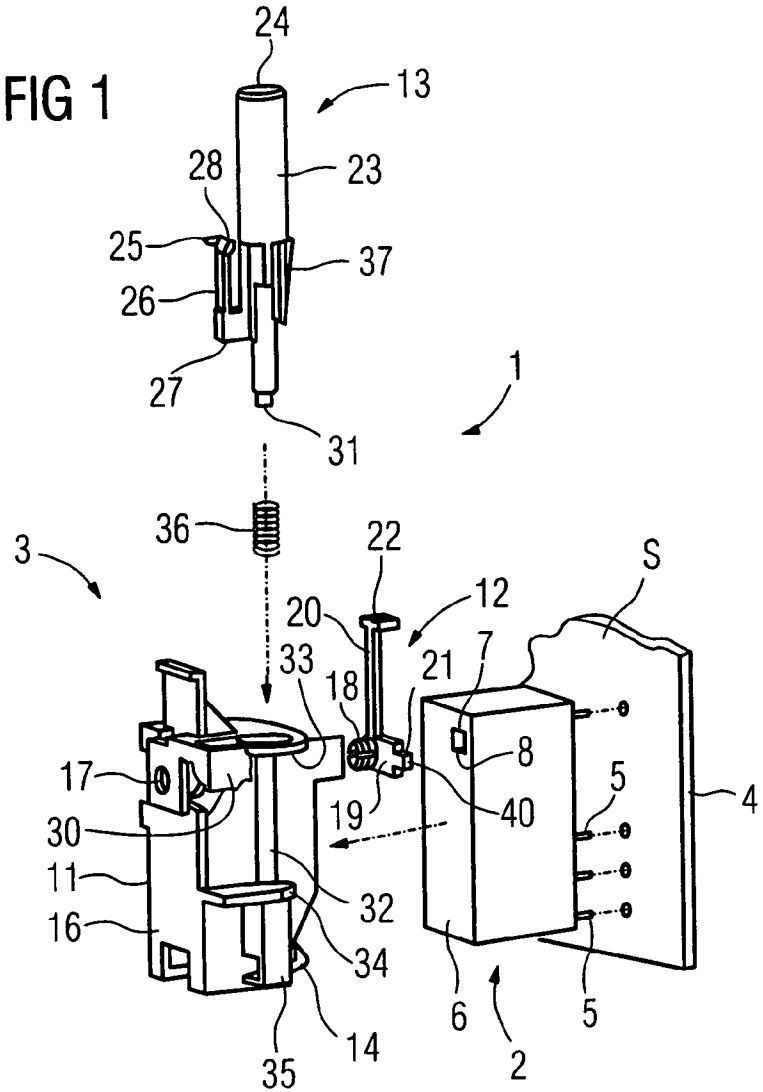
FIG. 1 shows an exploded illustration of an electronic function relay with a printed circuit board relay module, and with a separate reset mechanism which can be connected to it.

The function relay 1 illustrated in FIG. 1 has a printed circuit board relay module 2 as well as a reset mechanism 3 which can be snapped onto it. The function relay 1 also has a printed circuit board 4, which is fitted with an electronic overload tripping circuit S (which is not illustrated in any more detail in FIG. 1).

Figure 3:
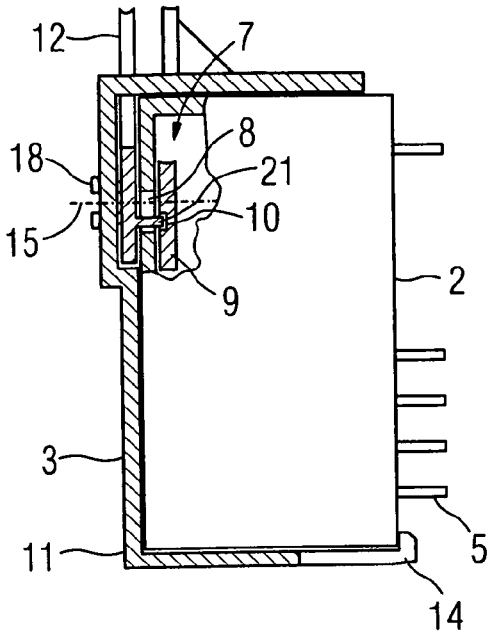
FIGS. 3 and 4 show an illustration, partially sectioned along III-III (as shown in FIG. 2), of the function relay in the switched-on state and in the switched-off state, respectively.
Figure 4:
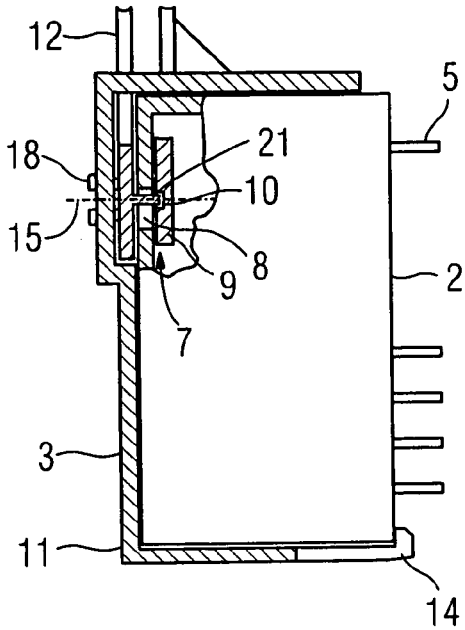

The printed circuit board relay module 2 (or relay module 2 for short) is a conventional, bistable relay which is intended for mounting on a printed circuit board, that is to say a bistable changeover switch which can be actuated electrically. Relay modules such as these are commercially available as mass-produced articles. The relay module 2 is provided with six contacts A1, A2, K1-K4, which are in the form of connecting pins 5, for mounting on the printed circuit board 4, and these contacts will be described in more detail in the following text. At the front end 6 remote from the connecting pins 5, the relay module 2 has an engagement point 7 via which the relay module 2 can be mechanically operated, that is to say switched, from the outside. The engagement point 7 is formed by a housing opening 8, behind which a moving part of a switching mechanism 9 (which is indicated in FIGS. 3 and 4) is arranged. The switching mechanism 9 is in this case provided with a depression 10 as the operating point for mechanical operation, particularly in the area of the housing opening 8.

Figure 2:
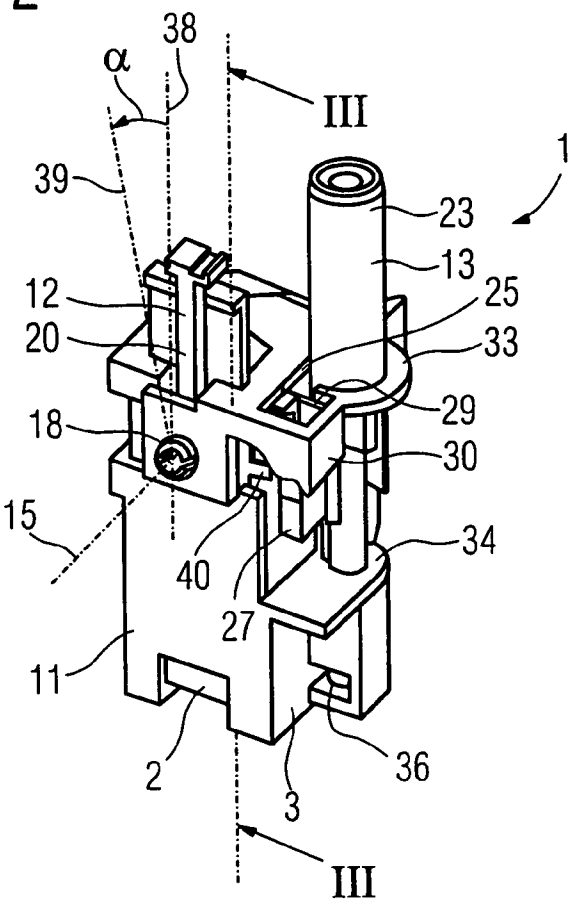
FIG. 2 shows a perspective illustration of the function relay in the installed state.

The reset mechanism 3 has a mounting frame 11, a rocker 12 and an operating element 13. The mounting frame 11 is in the form of a trough (as a rough simplification) and is of such a size that the relay module 2 can be inserted, with the front face 6 in front, with an accurate fit, into a space (which cannot be seen in FIG. 1) inside the mounting frame 11. In this case, the mounting frame 11 can be snapped onto the relay module 2 by means of latching elements 14 (only one of which can be seen in FIGS. 1 and 4). The mounting frame 11 is also used to mount the rocker 12 such that it can pivot about a pivoting axis 15 (FIG. 2). For this purpose, the mounting frame 11 has a hole 17 in a front wall 16, which hole 17 acts as a holder for a shaft attachment 18 on the rocker 12. In the installed position as shown in FIG. 2, the rocker 12 is fixed to the shaft attachment 18 in the hole 17 after snapping it on.

The rocker 12 is essentially L-shaped, with the shaft attachment 18 and the pivoting axis 15 which is defined by it being aligned at right angles to the plane of the L shape. The rocker 12 accordingly has two limbs 19, 20, which project approximately radially with respect to the pivoting axis 15.

The shorter limb 19 is fitted (at the remote end in the illustration shown in FIG. 1) with a switching lever 21 which projects like a stud in the opposite direction to the shaft attachment 18 and correspond with the engagement point 7 on the relay module 2. The longer limb 20 is fitted with a switch position indicator 22 at its free end.

The operating element 13 has an essentially cylindrical body 23 with an operating end 24, which acts as a pushing surface for a push button. The operating element 13 also has a driver 25, which is approximately in the form of a hook and is integrally formed on a base 27, which projects approximately radially from the body 23, via a spring arm 26 which is guided approximately parallel to the body 23 and at a distance from it. A guide stud 28 is also integrally formed on the driver 25, projects approximately in the tangential direction (and thus pointing obliquely out of the plane of the drawing in the illustration shown in FIG. 1) from the driver 25 with respect to the body 23, and in the process overhangs, in particular, the driver 25 and the spring arm 26. In this case, the guide stud 28 interacts with a guide web 29 (FIGS. 11 to 14) for positive guidance of the driver 25, with this guide web 29 being fitted on the inside to a guide section 30 of the mounting frame 11, and thus being concealed in FIG. 1.

An end 31 remote from the operating end 24 of the operating element 13 is inserted into a longitudinal guide 32 in the mounting frame 11, and is guided in this longitudinal guide 32 such that it can be moved between two guide collars 33 and 34. In this case, the operating element 13 is prestressed in a rest position by a compression spring 36 which is inserted in a spring box 35 of the mounting frame 11 and interacts with the end 31, and can be elastically deflected from this rest position against the spring pressure by exerting pressure on the operating end 24. A spring arm 37, which can be pushed elastically against the body 23, on the operating element 13 can be latched behind the guide collar 33 with the mounting frame 11.

FIG. 2 shows the installed position of the function relay 1, in which the rocker 12 and the operating element 13 are fixed together with the compression spring 36 on the mounting frame 11, and the reset mechanism 3 that is formed in this way is snapped onto the relay module 2. In this installed position, as can be seen from FIGS. 3 and 4, the switching lever 21 of the rocker 12 interacts with the engagement point 7, by engaging through the housing opening 8 in the depression 10 in the switching mechanism 9 of the relay module 2, and thus mechanically coupling the rocker 12 to the switching mechanism 9. As a result of this mechanical coupling, the pivoted position of the rocker 12 is unambiguously correlated with the switching state of the relay module 2. In particular, during switching of the relay module 2, the rocker 12 is also always pivoted in a characteristic manner, or the relay module 2 is switched during pivoting of the rocker 12.

FIG. 3 shows the relay module 2 in a switched-on state, which corresponds to a first pivoted position 38 of the rocker 12, in which the limb 20 of the rocker 12 is aligned (as illustrated in FIG. 2) approximately vertically "upwards", that is to say approximately parallel to the body 23 of the operating element 13.

A switched-off position of the relay module 2 as shown in FIG. 4 corresponds with a second pivoted position 39 of the rocker 12, in which the limb 20 (as is only indicated in FIG. 2) is aligned obliquely with respect to the body 23 of the operating element 13, and is thus tilted through an angle $\alpha$ with respect to the pivoted position 38.

The operating element 13 is operated in the form of a push button, by design, in order to reset the relay module 2 from the switched-off position as shown in FIG. 4 to the switched-on position as shown in FIG. 3. During this process, the driver 25 interacts with a free end 40 of the limb 19 in a manner which will be described in more detail in the following text, so that the rocker 12 is tilted from the pivoted position 39 to the pivoted position 38, and the relay module 2 is in consequence switched.

Figure 5:
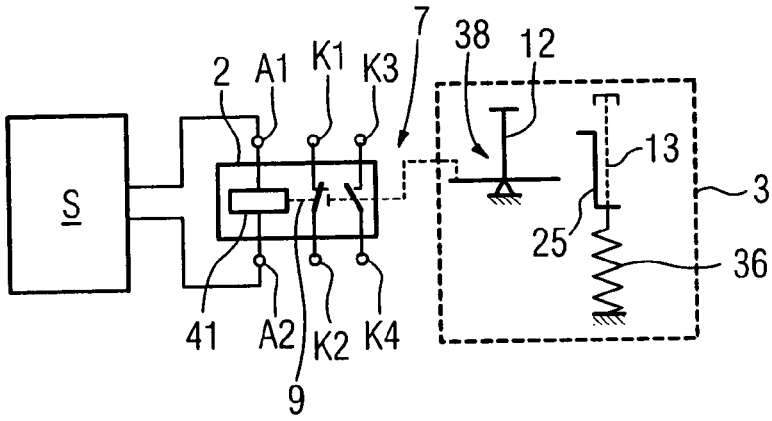
FIGS. 5 to 10 show schematic illustrations of the function relay in six successive positions during a reset process being carried out by the reset mechanism.
Figure 6:
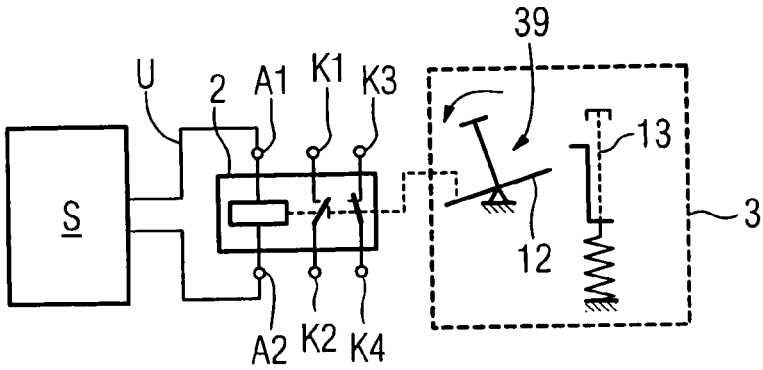

The principle of operation of the function relay 1 is illustrated schematically in FIGS. 5 to 10. FIG. 5 shows the relay module 2, and thus the function relay 1, in the switched-on position, in which a switching connection between contacts K1 and K2 is closed, and a further switching connection between contacts K3 and K4 is opened. An electromechanical release 41 of the relay module 2 is connected via two further contacts A1 and A2 to the electronic tripping circuit S which is mounted on the printed circuit board 4. The tripping circuit S is designed in such a manner that, in the event of an overload, it emits a tripping voltage U via the contacts A1 and A2 to the release 41. The release 41 converts the tripping voltage U to mechanical energy, which is transmitted through the release 41 to the switching mechanism 9, and results in the relay module 2 being switched to the switched-off state as shown in FIG. 6, in that the switching connection between the contacts K1 and K2 is opened, and the switching connection between the contacts K3 and K4 is closed. As the relay module 2 is switched off, the rocker 12 is tipped from the pivoted position 38 to the pivoted position 39 (FIG. 6).

Figure 7:
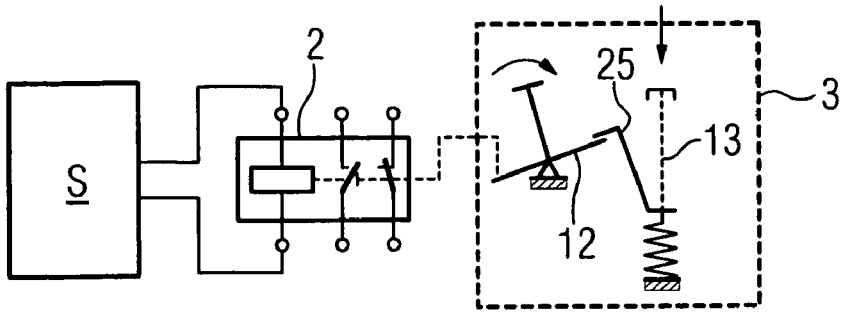
Figure 8:
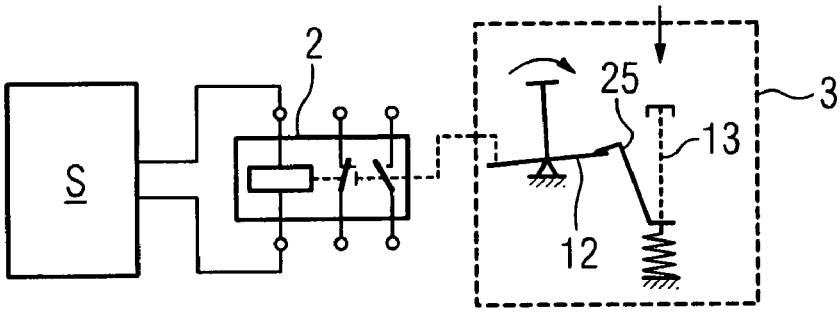
Figure 9:
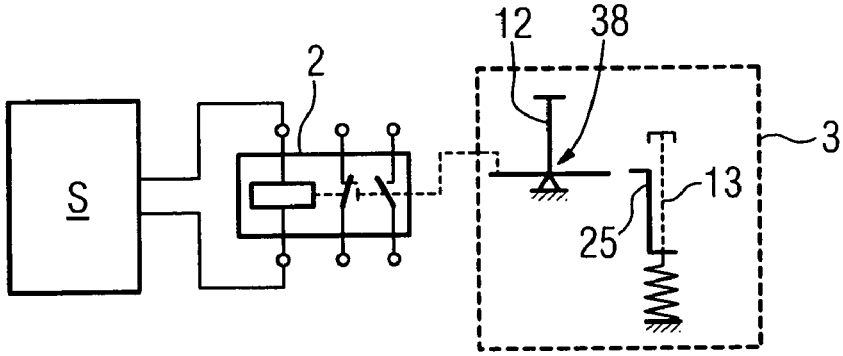

The operating element 13 is operated by pushing it, in order to reset the rocker 12 and the relay module 2 as shown in FIG. 7. In this case, the driver 25 is pivoted by way of positive guidance, which will be described in more detail in the following text, in such a manner that it is mechanically coupled to the rocker 12 which it pivots back in the direction of the pivoted position 38 as the movement of the operating element 13 continues (FIG. 8). During this backward pivoting, the rocker 12, as described above, switches the relay module 2 back to the switched-on state (FIG. 8).

The positive guidance is designed in such a way that the driver 25 is mechanically decoupled from the rocker 12 when the operating element 13 (in the operating position shown in FIG. 9) is pushed in entirely, and the rocker 12 is pivoted back to the pivoted position 38 during this process. The mechanical decoupling of the driver 25 from the rocker 12 results in free-tripping of the function relay 1. As can be seen from FIG. 9, the relay module 2 can be moved back to the switched-off state under the influence of the tripping circuit S, even if the operating element 13 is being pushed at this time.

Figure 10:
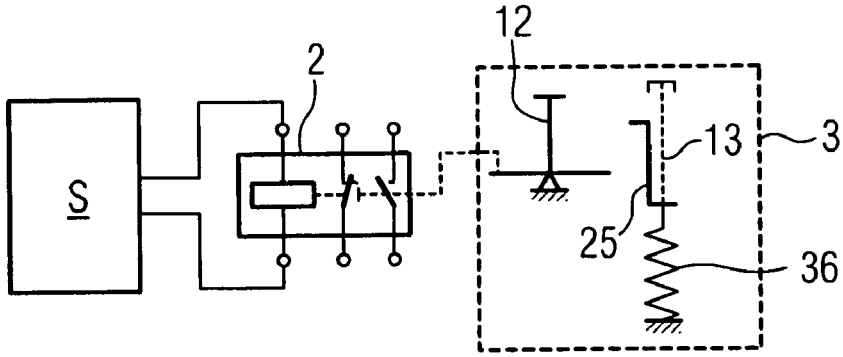

When the load is removed from the operating element 13 after the reset process, it returns back to the rest state as shown in FIG. 10, under the influence of the compression spring 36. The driver 25 in this case follows, in the state in which it is decoupled from the rocker 12. As can be seen from a comparison of FIGS. 10 and 4, this therefore re-establishes the initial state, as illustrated in FIG. 5.

Figure 11:
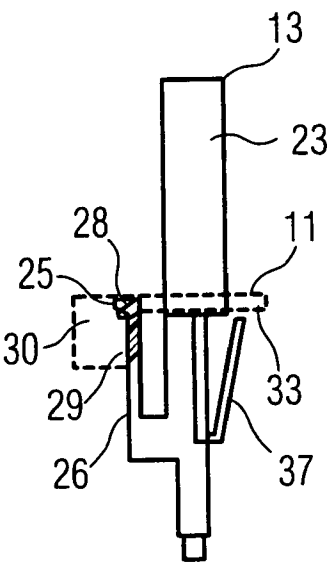
FIGS. 11 to 14 show schematic side views of an operating element of the reset mechanism with positive guidance for a driver, in four successive positions during the reset process.
Figure 12:
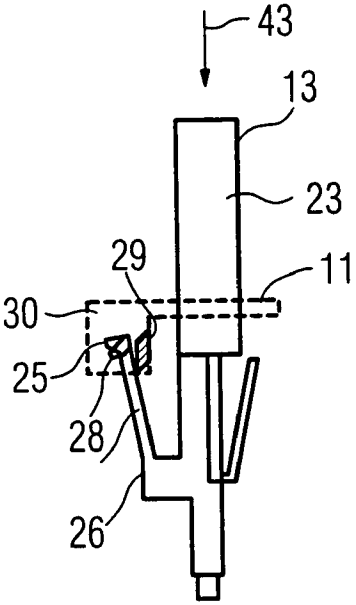

The method of operation of the positive guidance is illustrated schematically in more detail in FIGS. 11 to 14. As can be seen in particular from these figures, the guide stud 28 and the guide web 29, which interacts with it in order to form the positive guidance, are designed in such a manner that the guide stud 28 is deflected radially away from the body 23 on the guide web 29 when the operating element 13 is deflected from the rest position as shown in FIG. 11 in the operating direction 43 (FIG. 12). The driver 25 follows this deflection movement, with the spring arm 26 being elastically bent, and in the process latches with the free end 40, so that the driver 25 is coupled to the rocker 12.

Figure 13:
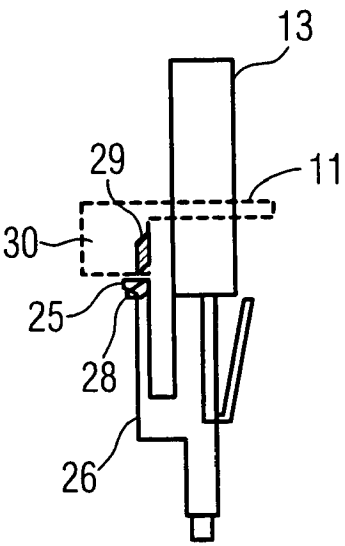
Figure 14:
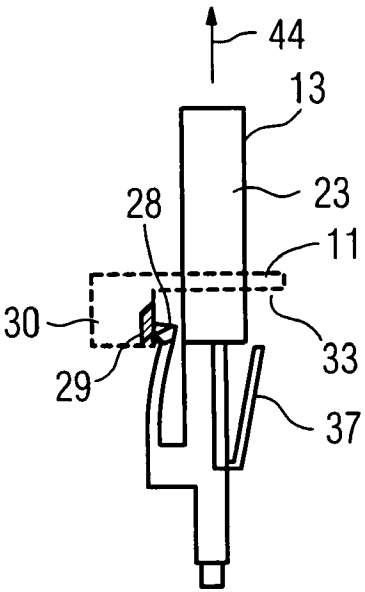

When the operating element 13 is in the operating position as shown in FIG. 13, the guide stud 28 and the guide web 29 lose the mutual contact, so that the driver 25 jumps back to the rest position under the influence of the resetting force that is produced by the spring arm 26, thus releasing the free end 40 of the rocker 12. When the load is removed from the operating element 13, this returns back to the original position (FIG. 14), in the load removal direction 44, driven by the compression spring 36. During this process, the guide stud 28 is deflected on the guide web 29 in the direction of the body 23 of the operating element 13, so that, in particular, the driver 25 also remains decoupled from the rocker 12. The operating element 13 is driven in the load-removal direction 44 by the compression spring 36 until the spring arm 37 strikes the guide collar 33. In this case, the initial position as shown in FIG. 11 has been re-established, so that the reset process can be started again.

The described circular guidance of the guide stud 28 around the guided web 29 is achieved in particular by the guide web 29 and/or the guide stud 28 being provided with appropriate sliding inclines on the surface which abut against one another during the movement of the operating element 13.

Example embodiments being thus described, it will be obvious that the same may be varied in many ways. Such variations are not to be regarded as a departure from the spirit and scope of the present invention, and all such modifications as would be obvious to one skilled in the art are intended to be include within the scope of the following claims.

What is claimed is:

1. An electronic function relay, comprising:

a bistable printed circuit board relay module, mechanically externally operateable via an engagement point in a housing of the printed circuit board relay module; and a reset mechanism, the reset mechanism including a switching lever, corresponding with the engagement point, and an operating element, manually elastically deflectable against spring pressure, to act via a driver on the switching lever such that, when the operating element is operated, the switching lever is moved to a reset position corresponding with the switched-on position of the printed circuit board relay module, the operating element is guided on a mounting frame of the reset mechanism in such a way that the driver is mechanically decoupled from the switching lever in a rest position and in an operating position of the operating element, the reset mechanism and the printed circuit board relay module being separate parts, and the reset mechanism being arranged external to the housing of the printed circuit board relay module, and being coupleable to the printed circuit board relay module.

2. The function relay as claimed in claim 1, wherein the switching lever is part of a rocker which is mounted to pivot on a supporting frame of the reset mechanism.

3. The function relay as claimed in claim 2, wherein, when the reset mechanism is connected to the printed circuit board relay module, the switching lever is fixed in the engagement point at the free end in such a manner that each switching state of the printed circuit board relay module corresponds with an unambiguously associated pivoted position of the rocker.

4. The function relay as claimed in claim 3, further comprising a switching state indicator, mechanically coupled to the rocker.

5. The function relay as claimed in claim 4, wherein the switching state indicator is formed by the free end of a limb, integrally formed on the rocker.

6. The function relay as claimed in claim 1, wherein the driver is deflectable with respect to a body of the operating element, and is guided on a positive guide on the mounting frame for coupling to and decoupling from the switching lever.

7. The function relay as claimed in claim 6, wherein the body is essentially cylindrical and is guided to be moveable axially on the mounting frame, in the form of a push button.

8. The function relay as claimed in claim 1, wherein the reset mechanism is snapable onto the printed circuit board relay module.

9. The function relay as claimed in claim 2, wherein the driver is deflectable with respect to a body of the operating element, and is guided on a positive guide on the mounting frame for coupling to and decoupling from the switching lever.

10. The function relay as claimed in claim 9, wherein the body is essentially cylindrical and is guided to be moveable axially on the mounting frame, in the form of a push button.

11. The function relay as claimed in claim 2, wherein the reset mechanism is snapable onto the printed circuit board relay module.

12. The function relay as claimed in claim 2, wherein the driver is deflectable with respect to a body of the operating element, and is guided on a positive guide on the mounting frame for coupling to and decoupling from the switching lever.

13. The function relay as claimed in claim 12, wherein the body is essentially cylindrical and is guided to be moveable axially on the mounting frame, in the form of a push button.

14. The function relay as claimed in claim 13, wherein the reset mechanism is snapable onto the printed circuit board relay module.

15. The function relay as claimed in claim 1, wherein the function relay is an overload relay.

16. The function relay as claimed in claim 2, wherein the function relay is an overload relay.

17. A reset mechanism for a relay, comprising:

a switching lever, corresponding with an engagement point of a relay module, and an operating element, manually elastically deflectable against spring pressure, to act via a driver on the switching lever such that, when the operating element is operated, the switching lever is moved to a reset position corresponding with the switched-on position of the relay module, the operating element is guided on a mounting frame of the reset mechanism in such a way that the driver is mechanically decoupled from the switching lever in a rest position and in an operating position of the operating element, the reset mechanism and the relay module being separate parts, and the reset mechanism being arranged external to a housing of the relay module, and being coupleable to the relay module.

18. A function relay comprising the reset mechanism as claimed in claim 17.

19. An overload relay comprising the reset mechanism as claimed in claim 17.

* * * * *